United States Patent [19]

Dreher et al.

[11] 4,100,081

[45] Jul. 11, 1978

[54] POLYUREA-BASED EXTREME PRESSURE GREASE

[75] Inventors: John L. Dreher, El Cerrito; Richard E. Crocker, Novato, both of Calif.

[73] Assignee: Chevron Research Company, San Francisco, Calif.

[21] Appl. No.: 777,365

[22] Filed: Mar. 14, 1977

[51] Int. Cl.[2] ..... C10M 1/32; C10M 3/26; C10M 5/20; C10M 7/30

[52] U.S. Cl. ..... 252/25; 252/51.5 A

[58] Field of Search ..... 252/25, 51.5 A

[56] References Cited

U.S. PATENT DOCUMENTS

| | | | |
|---|---|---|---|
| 2,987,476 | 6/1961 | Hartley et al. | 252/25 |
| 3,243,372 | 3/1966 | Dreher et al. | 252/51.5 A |
| 3,758,407 | 9/1973 | Harting | 252/25 |
| 3,940,339 | 2/1976 | Clarke et al. | 252/25 |

*Primary Examiner*—Delbert E. Gantz
*Assistant Examiner*—Irving Vaughn
*Attorney, Agent, or Firm*—C. J. Tonkin; J. Tedd Brooks

[57] ABSTRACT

Polyurea-based greases containing as an extreme-pressure additive an alkali metal triborate introduced or produced in the grease in aqueous solution.

6 Claims, No Drawings

POLYUREA-BASED EXTREME PRESSURE GREASE

BACKGROUND OF THE INVENTION

Field of the Invention

This application is concerned with improved polyurea-thickened greases containing alkali metal borate extreme-pressure agents prepared in situ.

Modern technology is currently supplying the general public and the process industries with machinery which is designed to operate under a wider range of temperatures and under greater loads than previously available. In addition, many of the newer machines are designed to operate at extremely high speeds. Many of these machines require certain specific lubricating properties which are not available in the conventional lubricants. Thus, modernization of high-speed and high-temperature equipment has strained the petroleum industry for the development of a second generation of lubricants capable of satisfying the requirements of the new machines. Recently, for example, there has been an increased demand for lubricants capable of performing well at temperatures above 300° F in high-speed bearings and gears for periods in excess of 500 hours. In addition, with the further development of the high-speed sealed bearings, the lubricant must be able to endure for the life of the bearing.

There have been numerous grease compositions developed which satisfy most of the new, more stringent requirements. Many of these compositions, however, are entirely too expensive for commercialization or only meet some of the lubricating requirements and fail in others.

One type of grease composition which has excellent lubricating properties at the higher temperatures is comprised of a lubricating oil (natural or synthetic) containing a polyurea additive. This type of lubricant is disclosed in U.S. Pat. Nos. 3,242,210, 3,243,372, 3,346,497 and 3,401,027, all assigned to Chevron Research Company. The polyurea component imparts a significant high-temperature stability to the grease and in fact effects a mild anti-thixotropic property, i.e., increases in viscosity with increasing shear, to the lubricant. This property of the lubricant is advantageous to prevent the segregation or loss of grease from the moving parts of the machine. However, the polyurea component does not impart extreme-pressure properties to the lubricant and, accordingly, EP additives must be added in applications involving high contact pressures. A need therefore exists for a grease composition which can be used in high-temperature and high-speed applications that exhibits good stability over prolonged periods, that exhibits both extreme-pressure and antiwear properties, and that is relatively inexpensive to produce.

In the past a variety of agents have been employed as EP agents in greases. However, many of these compounds are corrosive to metal. Included among these are phosphorus, sulfur, and chlorine-containing additives such as the esters of acids of phosphorus, sulfurized olefins, sulfurized aromatic compounds, chlorinated hydrocarbons, etc. In addition, lead compounds have been employed as EP additives. Environmental concerns have, however, made it desirable to eliminate lead-containing additives from greases. Alkali metal borates, specifically sodium metaborate, have been incorporated in various greases as EP agents with varying degrees of success. When they were employed as thickening agents, however, with polyurea-thickened greases, while the EP characteristics of the greases were enhanced, it was discovered that workers using the greases suffered skin staining due to hydrolysis of the polyurea thickeners by the alkaline borates. Tests with rabbits show this grease also can cause skin irritation.

It is thus desirable that polyurea grease compositions be provided which possess good EP characteristics achieved without enhancement of metal corrosivity and without the skin staining problems associated with the use of the metaborate in polyurea-based greases.

SUMMARY OF THE INVENTION

It has now been found that excellent greases possessing outstanding extreme-pressure properties comprising a major portion of an oil of lubricating viscosity, a minor portion, sufficient to thicken the composition to grease consistency, of a polyurea grease thickener, and a minor portion of an alkali metal triborate introduced into the grease in aqueous solution. In a preferred embodiment, the triborate is formed by reacting in the grease from about 1 to 10 mols of solid boric acid to one mol of alkali metal hydroxide in aqueous solution. Alternatively, the triborate is formed by reacting the base and the boric acid in aqueous solution and adding the product to the grease. In each case, water is substantially removed from the grease by heating.

The preferred molar ratio of hydroxide to boric acid is about 1:3.

Polyurea Component

The mono- or polyurea component of this invention is a water- and oil-insoluble organic compound having a molecular weight between about 375 and 2500 and having at least one ureido group and preferably between about 2 to 6 ureido groups. A ureido group as referred to herein is defined as

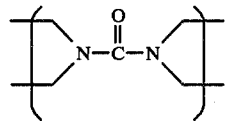

A particularly preferred polyurea compound has an average between 3 and 4 ureido groups and has a molecular weight between about 600 and 1200.

The mono- or polyurea compounds are prepared by reacting the following components:

I. A diisocyanate having the formula OCN-R-NCO wherein R is a hydrocarbylene having from 2 to 30 carbons and preferably from 6 to 15 carbons and more preferably 7 carbons.

II. A polyamine having a total of 2 to 40 carbons and having the formula

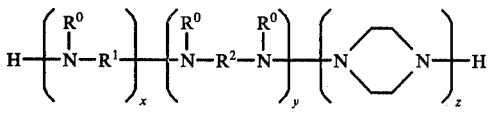

wherein $R^1$ and $R^2$ are the same or different type of hydrocarbylenes having from 1 to 30 carbons and preferably from 2 to 10 carbons and more preferably from 2 to 4 carbons, $R^0$ is selected from hydrogen or a $C_1$–$C_4$ alkyl and preferably hydrogen; $x$ is an integer from 0 to 2; $y$ is 0 or 1; and $z$ is an integer equal to 0 when $y$ is 1 and equal to 1 when $y$ is 0.

III. A monofunctional compound selected from the group consisting of monoisocyanate having 1 to 30 carbons, preferably from 10 to 24 carbons, a monoamine having from 1 to 30 carbons, preferably from 10 to 24 carbons, and mixtures thereof.

The reaction can be conducted by contacting the three reactants in a suitable reaction vessel at a temperature between about 60° to 320° F, preferably from 100° to 300° F, for a period from 0.5 to 5 hours and preferably from 1 to 3 hours. The molar ratio of the reactants present usually varies from 0.1–2 mols of monoamine or monoisocyanate and 0–2 mols of polyamine for each mol of diisocyanate. When the monoamine is employed, the molar quantities are preferably $(n+1)$ mols of diisocyanate, $(n)$ mols of diamine and 2 mols of monoamine. When the monoisocyanate is employed, the molar quantities are preferably $(n)$ mols of diisocyanate, $(n+1)$ mols of diamine and 2 mols of monoisocyanate.

A particularly preferred class of mono or polyurea compounds has structures defined by the following general formulas:

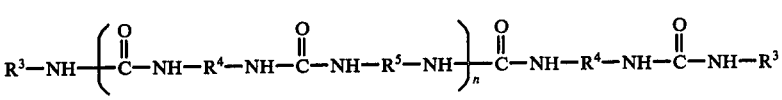

(1)

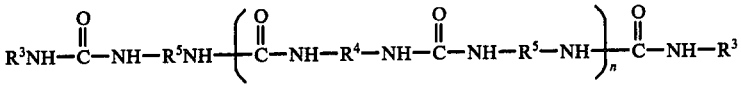

(2)

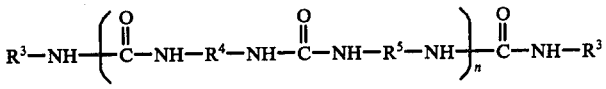

(3)

wherein $n$ is an integer from 0 to 3; $R^3$ is the same or different hydrocarbyl having from 1 to 30 carbon atoms, preferably from 10 to 24 carbons; $R^4$ is the same or different hydrocarbylene having from 2 to 30 carbon atoms, preferably from 6 to 15 carbons; and $R^5$ is the same or different hydrocarbylene having from 1 to 30 carbon atoms, preferably from 2 to 10 carbons.

As referred to herein, hydrocarbyl is a monovalent organic radical composed of hydrogen and carbon and may be aliphatic, aromatic or alicyclic or combinations thereof, e.g., aralkyl, alkyl, aryl, cycloalkyl, alkylcycloalkyl, etc., and may be saturated or olefinically unsaturated (one or more double-bonded carbons, conjugated or nonconjugated). The hydrocarbylene, as defined in $R^1$ and $R^2$ above, is a divalent hydrocarbon radical which may be aliphatic, alicyclic, aromatic or combinations thereof, e.g., alkylarylene, aralkylene, alkylcycloalkylene, cycloalkylarylene, etc., having its two free valences on different carbon atoms.

The mono- or polyureas having the structure presented in Formula (1) above are prepared by reacting $(n+1)$ mols of diisocyanate with two mols of a monoamine and $(n)$mols of a diamine. (When $n$ equals zero in the above Formula (1), the diamine is deleted.) Mono or polyureas having the structure presented in Formula (2) above are prepared by reacting $(n)$ mols of a diisocyanate with $(n+1)$ mols of a diamine and two mols of a monoisocyanate. (When $n$ equals zero in the above Formula (2), the diisocyanate is deleted). Mono- or polyureas having the structure presented in Formula (3) above are prepared by reacting $(n)$ mols of a diisocyanate with $(n)$ mols of a diamine and one mol of a monoisocyanate and one mol of a monoamine. (When $n$ equals zero in Formula (3), both the diisocyanate and diamine are deleted.)

In preparing the above mono- or polyureas, the desired reactants (diisocyanate, monoisocyanate, diamine and monoamine) are admixed within a suitable reaction vessel in the proper proportions. The reaction may proceed without the presence of a catalyst and is initiated by merely contacting the component reactants under conditions conducive for the reaction. Typical reaction temperatures range from 20° C to 100° C under atmospheric pressure. The reaction itself is exothermic and, accordingly, by initiating the reaction at room temperature, elevated temperatures are obtained. However, external heating or cooling may be desirable.

REACTANTS

The monoamine or monoisocyanate used in the formulation of the mono or polyurea will form the terminal end groups. These terminal end groups will have from 10 to 30 carbon atoms, but are preferably from 5 to 28 carbons, and more desirably from 6 to 25 carbons.

Illustrative of various monoamines are pentylamine, hexylamine, heptylamine, octylamine, decylamine, dodecylamine, tetradecylamine, hexadecylamine, octadecylamine, eicosylamine, dodecenylamine, hexadecenylamine, octadecenylamine, octadecadienylamine, abietylamine, aniline, toluidene, naphthylamine, cumylamine, bornylamine, fenchylamine, tertiary butyl aniline, benzylamine, beta-phenyethylamine, etc. Particularly preferred amines are prepared from natural fats and oils or fatty acids obtained therefrom. These starting materials can be reacted with ammonia to give first amides and then nitriles. The nitriles are then reduced to amines, conveniently be catalytic hydrogenation. Exemplary amines prepared by the method include stearylamine, laurylamine, palmitylamine, olcylamine, petroselinylamine, linoleylamine, linolenylamine, eleostearylamine, etc. The unsaturated amines are particularly preferred.

Illustrative of monoisocyanates are hexylisocyanate, decylisocyanate, dodecylisocyanate, tetradecylisocyanate, hexadecylisocyanate, phenylisocyanate, cyclohexylisocyanate, xyleneisocyanate, cumeneisocyanate, abietylisocyanate, cyclooctylisocyanate, etc.

The polyamines, which form the internal hydrocarbon bridges between the ureido groups, usually contain from 2 to 40 carbons and preferably from 20 to 30 carbons, more preferably from 2 to 20 carbons. Exemplary polyamines include diamines such as ethylene diamine, propane diamine, butane diamine, hexane diamine, dodecane diamine, octane diamine, hexadecane diamine, cyclohexane diamine, cyclooctane diamine, phenylene diamine, tolylene diamine xylylene diamine, dianiline methane, ditoluidine methane, bis(toluidine), piperazine, etc., triamines, such as aminoethyl piperazine, diethylene triamine, dipropylene triamine, N-methyldiethylene triamine, etc., and higher polyamines such as triethylene tetramine, tetraethylene pentamine, pentaethylene hexamine, etc.

Representative examples of diisocyanates include hexane diisocyanate, decane diisocyanate, octadecane diisocyanate, phenylene diisocyanate, tolylene diisocyanate, bis(diphenylisocyanate), methylene bis(-phenylisocyanate), etc.

Another preferred class of mono-polyurea compounds which may be successfully employed in the practice of this invention include the following:

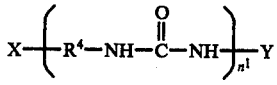

wherein $n^1$ is an integer of 1 to 3, $R^4$ is defined supra, X and Y are monovalent radicals selected from Table I below.

TABLE I

| X | Y |
|---|---|
| $R^7-C(=O)-NH-$ | $R^7-C(=O)-NH-R^5-$ |
| 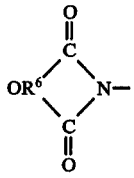 | 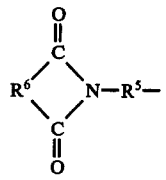 |
| | $R^8-$ |

In the Table, $R^5$ is defined supra, $R^8$ is the same as $R^3$ and defined supra, $R^6$ is selected from the group consisting of arylene radicals of 6 to 16 carbon atoms and alkylene groups of 2 to 30 carbon atoms, and $R^7$ is selected from the group consisting of alkyl radicals having from 10 to 30 carbon atoms and aryl radicals having from 6 to 16 carbon atoms.

Mono- or polyurea compounds described by the above formula (4) can be described as amides and imides of mono, di and tri ureas. These materials are formed by reacting in the selected proportions of suitable carboxylic acids or internal carboxylic anhydrides, with a diisocyanate and a polyamine with or without a monoamine or monoisocyanate. The mono- or polyurea compounds are prepared by blending the several reactants together in a suitable reaction vessel and heating them to a temperature ranging from 70° F to 400° F for a period sufficient to cause formation of the compound, generally from 5 minutes to 1 hour. The reactants can be added all at once or sequentially.

Suitable carboxylic acids include aliphatic carboxylic acids of about 11 to 31 carbon atoms and aromatic carboxylic acid of 7 to 17 carbon atoms. Examples of suitable acids include aliphatic acids such as lauric, myristic, palmitic, margaric, stearic, arachidic, behenic, lignoceric acid, etc.; and aromatic acids such as benzoic acid, 1-naphthoic acid, 2-naphthoic acid, phenylacetic acid, hydrocinnamic acid, cinnamic acid, mendelic acid, etc. Suitable anhydrides which may be employed are those derived from dibasic acids which form a cyclic anhydride structure, for example, succinic anhydride, maleic anhydride, phthalic anhydride, etc. Substituted anhydrides, such as alkenyl succinic anhydride of up to 30 carbon atoms, are further examples of suitable materials.

Examples of suitable diisocyanates, monoisocyanates, monoamines and polyamines are described supra.

The mono- or polyurea compounds are generally mixtures of compounds having structures wherein $n^1$ varies from 0 to 4, or $n^1$ varies from 1 to 3, existent within the grease composition at the same time. For example, when a monoamine, a diisocyanate and a diamine are concurrently present within the reaction zone, as in the preparation of mono- or polyureas having the structure shown in Formula (2), some of the monoamine may react with both sides of the diisocyanate to form a diurea. In addition to the formulation of diurea, simultaneous reactions can be occurring to form the tri, tetra, penta, hexa, octa, etc., ureas. Particularly good results have been realized when the polyurea compound has an average of 4 ureido groups.

The amount of mono- or polyurea compound in the final grease composition will be sufficient to thicken the base oil to the consistency of grease. Generally, the amount of mono- or polyurea will range from 1 to 50 weight percent and preferably from 2 to 7 weight percent of the final grease composition.

In instances where an oil concentrate is desired, the concentration of the mono- or polyurea compound in the base oil or an oleaginous organic liquid can vary between about 10 and 30 weight percent of the final concentrate. The employment of concentrates provides a convenient method of handling and transporting the mono- or polyurea compounds for subsequent dilution and use.

BASE OIL

The second component which must necessarily be present in the composition of this invention is a liquid base oil. The base oils which may be employed herein include a wide variety of lubricating oils such as naphthenic-base, paraffin-base, and mixed-base lubricating oils. Other hydrocarbon oils include lubricating oils derived from coal products and synthetic oils, e.g., alkylene polymers (such as polymers of propylene, butylene, etc., and mixtures thereof), alkylene oxide-type polymers (e.g., alkylene oxide polymers prepared by polymerizing alkylene oxide, e.g., propylene oxide polymers, etc., in the presence of water or alcohols, e.g., ethyl alcohol), carboxylic acid esters (e.g., those which were prepared by esterifying such carboxylic acids as adipic acid, azelaic acid, suberic acid, sebacic acid, alkenyl succinic acid, fumaric acid, maleic acid, etc., with the alcohols such as butyl alcohol, hexyl alcohol, 2-ethylhexyl alcohol, etc.), liquid esters of acids of phosphorus, alkylbenzenes, polyphenols (e.g., biphenols and terphenols), alkyl biphenol ethers, polymers of silicon, e.g., tetraethyl silicate, tetraisopropyl silicate, tetra(4-methyl-2-tetraethyl) silicate, hexyl(4-methyl-2-pentoxy) disilicone, poly(methyl) siloxane, and poly(methylphenyl) siloxane, etc. The base oils may be used individually or in combinations, whenever miscible or whenever made so by use of mutual solvents.

OTHER ADDITIVES

In addition to the mono- or polyurea and alkaline earth metal borate, other additives may be successfully employed within the grease composition of this invention without affecting its high stability and performance over a wide temperature scale. One type of additive is an antioxidant or oxidation inhibitor. This type of additive is employed to prevent varnish and sludge formation on metal parts and to inhibit corrosion of alloyed bearings. Typical antioxidant are organic compounds containing sulfur, phosphorus or nitrogen, such as organic amines, sulfides, hydroxy sulfides, phenols, etc., alone or in combination with metals such as zinc, tin or barium. Particularly useful grease antioxidants include phenyl-alpha-naphthylamine, bis(alkylphenyl)amine, N,N-diphenyl-p-phenylene diamine, 2,2,4-trimethyl-dihydroquinoline oligomer, bis(4-isopropylaminophenyl) ether, N-acyl-p-aminophenol, N-acylphenothiazines, N-hydrocarbylamides of ethylene diamine tetra-acetic acid, alkylphenol-formaldehyde-amine polycondensates, etc.

Another additive which may be incorporated into the grease composition of this invention is an anti-corrodant. The anti-corrodant is employed to suppress attack by acidic bodies and to form protective films over the metal surfaces which decrease the effect of corrosive materials on exposed metallic parts. A particularly effective corrosion inhibitor is an alkali metal nitrite and preferably sodium nitrite. The combination of the polyurea thickener and alkaline earth metal carboxylate has been found to work exceedingly well within the alkali metal nitrite. When this corrosion inhibitor is employed, it is usually used at a concentration of 0.1 to 5 weight percent and preferably from 0.2 to 2 weight percent, based on the weight of the final grease composition.

Another type of additive which may be employed herein is a metal deactivator. This type of additive is employed to prevent or counteract catalytic effects of metal on oxidation generally by forming catalytically inactive complexes with soluble or insoluble metal ions. Typical metal deactivators include complex organic nitrogen and sulfur-containing compounds such as certain complex amines and sulfides. An exemplary metal deactivator is mercaptobenzothiazole.

In addition to the above, several other grease additives may be employed in the practice of this invention and include stabilizers, tackiness agents, dropping point improvers, lubricating agents, color correctors, odor control agents, etc.

PREPARATION OF GREASE COMPOSITION

The preparation of the extreme-pressure grease is effected in conventional grease blending equipment. Preferably, the boric acid is added as a powder to the grease, usually at a temperature in the range 100° to 300° F, usually 150° to 250° F, and mixed thoroughly. The aqueous solution of base is added slowly and stirred, the temperature is then raised to elevated temperature, preferably of 300° F to remove water from the grease.

EXAMPLES

The following examples are presented to illustrate the practice of specific embodiments of this invention and should not be interpreted as limitations upon the scope of the invention.

EXAMPLE I

A polyurea grease was prepared by reacting in a solvent refined West Coast oil, oleylamine, tolylene diisocyanate, and ethylene diamine. To 1908 g of the grease was added 132.5 g of powdered $H_3BO_3$. The grease was stirred 30 minutes at 180° F. 85 g of 50% aqueous KOH was added. The grease was stirred at 180° F for 15 minutes. 25 g of 50% $NaNO_2$ solution was added and the temperature was raised to 300° F. The grease was cooled to room temperature, and 767.75 g of oil was added. The grease was milled in a 3-roll mill. 150 g of oil was added, and after two additional millings, the grease had an unworked penetration of 231 and a worked penetration ($P_{60}$) of 314.

EXAMPLE II

The procedure of Example I was followed, with the exception that the boric acid and KOH were prereacted in aqueous solution before addition to the grease. The molar ratio of acid to base was 1 to 6.3.

The greases of Examples I and II were subjected to a Timken test to determine the maximum passing load. The test procedure is set forth in ASTM D-2509. The result are set forth in the following table.

The greases of Examples I and II, a commercial polyurea grease and a commercial extreme pressure grease (polyurea-acetate) were subjected to a Timken test (ASTM D-2509) and a High Speed Bearing Life Test (ASTM D-3336). The results are set forth in the following table. ASTM worked penetration ($P_{60}$) and the polyurea and borate contents of the greases are reported.

TABLE II

| Grease | Timken, Max. OK Load Lbs. | ASTM D-3336 High-Speed Bearing Life, Hrs. at 350 F | $P_{60}$ | Polyurea Content, Wt. % | Borate Content, Wt. % | Irritation Score After 2 Hours[1] |
|---|---|---|---|---|---|---|
| Ex. I | 55 | 325 | 314 | 6.6 | 6.6 | 3.3 |
| Ex. II | 45 | 439 | 339 | 7.2 | 7.2 | — |
| Commercial Polyurea Grease | <20 | 452 | 320 | 8.1 | 0 | 2.7 |
| Commercial Polyurea-Acetate E.P. Grease | 50–60 | 294 | 320 | 4.0 | 0 | 2.7 |
| $NaBO_2$ Grease | 55 | — | 308 | 6.5 | 6.3 | 6.3 |

[1]Irritation scores by the method of J. H. Draize, G. Woodward, and H. O Calvery. J.Pharmacol. Exptl. Therap., 82, 377-390 (1944).

These data show that the greases containing the triborates have EP properties comparable to the commercial EP grease, and have higher high speed bearing lives.

The grease of Example I, and one having the same base, but containing sodium metaborate as an EP additive were tested for skin irritation on rabbits. The grease containing the triborate produced only slight irritation; that with metaborate, severe irritation (see Table). Skin staining was obtained with humans who contacted the latter grease.

While the character of this invention has been described in detail with numerous examples, this has been done by way of illustration only and without limitation of the invention. It will be apparent to those skilled in the art that modifications and variations of the illustrative examples may be made in the practice of the invention within the scope of the following claims.

What is claimed is:

1. A grease comprising a major portion of an oil of lubricating viscosity, a minor portion of polyurea, sufficient to thicken said oil to grease consistency, and a minor portion, sufficient to impart extreme-pressure properties to the grease, of a potassium or sodium triborate, said borate being introduced into the grease in aqueous solution, said polyurea comprising a water- and oil-insoluble organic compound having a molecular weight between about 375 and 2500 and having at least one ureido group.

2. The grease of claim 1 in which the borate is produced by reacting in the grease boric acid with an aqueous solution of alkali metal hydroxide in a ratio of about 1 mol of hydroxide to about 1 to 10 mols of boric acid, followed by heating said grease at elevated temperature for a period sufficient to substantially remove the water from the grease.

3. The grease of claim 1 wherein the grease thickener is present in the amount of about 1% to 50% by weight in the grease.

4. The grease of claim 3 wherein the grease thickener is present in the amount of about 2% to 7% by weight.

5. The grease of claim 2 wherein the alkali metal hydroxide is KOH.

6. The grease of claim 2 wherein the aqueous solution contains from about 5% to 60% of alkali metal hydroxide.

* * * * *